United States Patent [19]

Robertson et al.

[11] 4,091,352

[45] May 23, 1978

[54] CIRCUIT BREAKER PROTECTED ELECTRICAL RECEPTACLE

[76] Inventors: Melvin W. Robertson; William L. Wenzel, both of 18 Cherry Ave., Woodbury Heights, N.J. 08097

[21] Appl. No.: 702,997

[22] Filed: Jul. 6, 1976

[51] Int. Cl.[2] ..... H01H 85/02

[52] U.S. Cl. ..... 337/187; 337/197

[58] Field of Search ..... 337/3, 187, 197, 198, 337/200, 268, 269

[56] References Cited

U.S. PATENT DOCUMENTS

| | | | |
|---|---|---|---|
| 2,667,547 | 1/1954 | Lindeman | 337/197 |
| 3,539,961 | 11/1970 | Worthington | 337/197 |
| 3,585,555 | 6/1971 | Yamada | 337/187 |
| 3,612,953 | 10/1971 | Gittin | 337/198 X |
| 3,913,046 | 10/1975 | Davis et al. | 337/3 X |

*Primary Examiner*—George Harris

*Attorney, Agent, or Firm*—Duffield & Lehrer

[57] ABSTRACT

An electrical circuit receptable having a circuit breaker mounted in the central portion of the receptacle between two plug sockets and the circuit breaker connected between one side of each of the sockets and thence to a live side of the external electrical source.

1 Claim, 4 Drawing Figures

CIRCUIT BREAKER PROTECTED ELECTRICAL RECEPTACLE

We have invented a new and novel circuit breaker protected electrical receptacle. Our receptacle has a built in circuit breaker to shut the current to the receptacles when a short occurs or an overload occurs in any appliance using the receptacle. This will prevent or greatly reduce the danger of overheating or short circuits within the electrical wiring of the building by eliminating the overloaded circuit at the source rather than at the fuse box located somewhere else in the building and furthermore the user can quickly identify the actual appliance that is causing the problem.

My invention can be understood in view of the accompanying figures.

Figure 1:
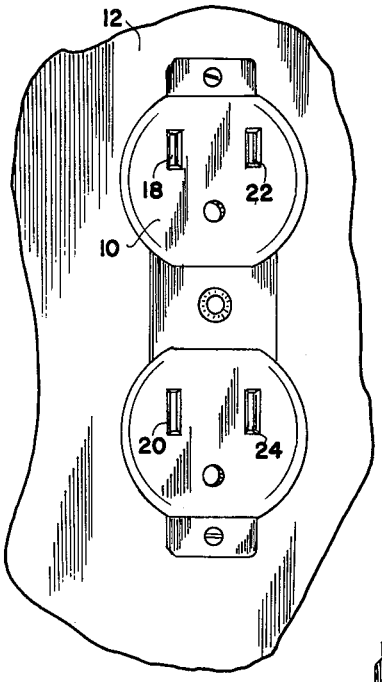
FIG. 1 is a front view of the receptacle.
Figure 2:
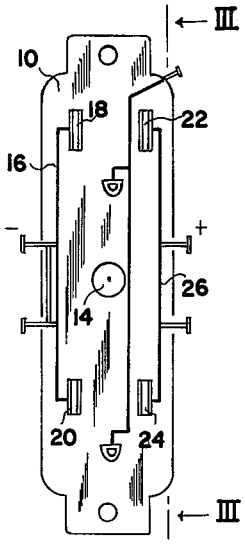
FIG. 2 is a front view of the receptacle with the face plate of the receptacle removed showing the circuitry.
Figure 3:
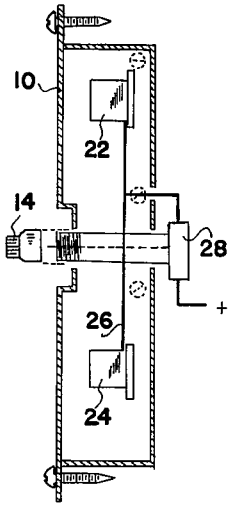
FIG. 3 is a section of the receptacle in FIG. 2 taken in the plane 3-3.
Figure 4:
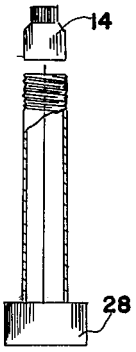
FIG. 4 is a close up of the circuit breaker.

With regard to FIGS. 1, 2, 3 and 4, a receptacle 10 can be mounted in a wall 12 and a circuit breaker tip 14 can be seen mounted in the front of the receptacle 10. A line 16 connects a negative side of the circuit from an external source to the sockets 18 and 20. The positive sockets 22 and 24 are connected by a line 26 through the base of the resettable electromechanical circuit breaker base 28 to the positive side of the external electrical circuit. When an overload occurs in the circuit of the receptacle 10 the circuit breaker base 28 is lifted up disconnecting the positive side of the current source from the receptacle sockets 22 and 24, thereby shutting off power to the receptacle and the utensiles using the receptacle. The button 14 can be depressed again to reactivate the circuit breaker 28 when the problem has been corrected. The grounding prong of the receptacle can be connected separately to the safety grounding in the usual way.

Having described a preferred embodiment of our invention, it is understood that various changes can be made without departing from the spirit of our invention, and, we desire to cover by the appended claims all such modifications as fall within the spirit and scope of our invention.

What we claim and seek to secure by Letters Patent is:

1. A circuit breaker protected electrical receptacle comprising:

a duplex electrical receptacle including a body member having a pair of spaced apart electrical outlets, each of said outlets including a pair of parallel sockets, said receptacle including means for connecting the same directly to external electrical wiring;

a resettable electromechanical circuit breaker electrically connected to said outlets, said circuit breaker being mounted adjacent the rear of said body member and including an actuator for resetting said circuit breaker, said actuator extending from the rear of said body member into the central portion thereof and being accessible from the front of said body member at a central location between said pair of outlets.

* * * * *